US010669806B2

(12) United States Patent
Al-AbdulJabbar et al.

(10) Patent No.: US 10,669,806 B2
(45) **Date of Patent: *Jun. 2, 2020**

(54) SWELLABLE SEALS FOR WELL TUBING

(71) Applicant: Saudi Arabian Oil Company, Dhahran (SA)

(72) Inventors: Ahmad Mohammad Al-AbdulJabbar, Dammam (SA); Kamal Eldarovic Aghazada, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 16/413,474

(22) Filed: May 15, 2019

(65) Prior Publication Data

US 2019/0264528 A1 Aug. 29, 2019

Related U.S. Application Data

(63) Continuation of application No. 15/617,853, filed on Jun. 8, 2017, now Pat. No. 10,358,888.

(51) Int. Cl.

| | |
|---|---|
| ***E21B 33/10*** | (2006.01) |
| ***E21B 33/12*** | (2006.01) |
| ***E21B 43/10*** | (2006.01) |

(52) U.S. Cl.

CPC ..... *E21B 33/12* (2013.01); *E21B 33/10* (2013.01); *E21B 33/1208* (2013.01); *E21B 43/10* (2013.01)

(58) Field of Classification Search

CPC ..... E21B 33/12; E21B 33/10; E21B 33/1208; E21B 43/10; E21B 43/12; E21B 23/00

See application file for complete search history.

(56) References Cited

U.S. PATENT DOCUMENTS

| | | | |
|---|---|---|---|
| 4,473,231 A | 9/1984 | Tilton et al. | |
| 8,925,631 B2 | 1/2015 | Patel | |
| 9,200,498 B2 | 12/2015 | Klimack | |
| 9,441,455 B2 | 9/2016 | O'Malley | |
| 10,358,888 B2 * | 7/2019 | Al-Abduljabbar | E21B 33/12 |

(Continued)

FOREIGN PATENT DOCUMENTS

WO 2016007701 1/2016

OTHER PUBLICATIONS

International Search Report and Written Opinion issued in International Application No. PCT/US2018/035548 dated Sep. 5, 2018, 15 pages.

(Continued)

*Primary Examiner* — David J Bagnell
*Assistant Examiner* — Yanick A Akaragwe
(74) *Attorney, Agent, or Firm* — Fish & Richardson P.C.

(57) ABSTRACT

A wellbore liner-hanger tie-back system includes a bore receptacle coupled with a liner hanger at a downhole end of the bore receptacle, where the liner hanger is configured to be positioned in a wellbore, a tieback casing configured to be disposed in the wellbore, where a portion of an outer surface of the tieback casing is disposed proximate to an inner surface of the bore receptacle, and a seal system including at least one swellable seal. The seal system is disposed between the tieback casing and the bore receptacle to seal a space between the portion of the outer surface of the tieback casing and the inner surface of the bore receptacle.

5 Claims, 7 Drawing Sheets

(56) References Cited

U.S. PATENT DOCUMENTS

| | | | | |
|---|---|---|---|---|
| 2006/0272818 | A1* | 12/2006 | Adam | E21B 21/10 166/285 |
| 2009/0107675 | A1 | 4/2009 | Eriksen et al. | |
| 2009/0205843 | A1 | 8/2009 | Gandikota et al. | |
| 2010/0300689 | A1 | 12/2010 | McRobb et al. | |
| 2010/0314130 | A1 | 12/2010 | Durst et al. | |
| 2013/0062072 | A1 | 3/2013 | Alvarez et al. | |
| 2013/0146276 | A1* | 6/2013 | Klimack | E21B 33/10 166/116 |
| 2015/0034337 | A1 | 2/2015 | Hughes et al. | |
| 2015/0226012 | A1 | 8/2015 | Zhou | |
| 2016/0010411 | A1 | 1/2016 | Al-Rabeh | |
| 2016/0184480 | A1 | 6/2016 | Cox et al. | |
| 2016/0312586 | A1 | 10/2016 | De Clute-Melancon | |

OTHER PUBLICATIONS

Gulf Cooperation Council Examination Report issued in GCC Application No. 2018-35445 dated Dec. 10, 2019, 4 pages.

* cited by examiner

SWELLABLE SEALS FOR WELL TUBING

CLAIM OF PRIORITY

This application claims priority to and is a continuation of U.S. patent application Ser. No. 15/617,853, filed on Jun. 8, 2017, the entire contents of which are hereby incorporated by reference.

TECHNICAL FIELD

This disclosure relates to wellbore drilling and completion.

BACKGROUND

In hydrocarbon production, a wellbore is drilled into a hydrocarbon-rich geological formation. After the wellbore is partially or completely drilled, a completion system is installed to secure the wellbore in preparation for production or injection. The completion system can include a series of casings or liners cemented in the wellbore to help control the well and maintain well integrity.

SUMMARY

This disclosure describes swellable seals for well tubing, such as liner-hanger tie-back systems, for example, between a bore receptacle and a tieback casing in a well.

In some aspects, a wellbore liner-hanger tie-back system includes a bore receptacle coupled with a liner hanger at a downhole end of the bore receptacle, where the liner hanger is configured to be positioned in a wellbore, a tieback casing configured to be disposed in the wellbore, where a portion of an outer surface of the tieback casing is disposed proximate to an inner surface of the bore receptacle, and a seal system including at least one swellable seal. The seal system is disposed between the tieback casing and the bore receptacle to seal a space between the portion of the outer surface of the tieback casing and the inner surface of the bore receptacle.

This, and other aspects, can include one or more of the following features. The seal system can be fixed to the portion of the outer surface of the tieback casing. The seal system can be fixed to the inner surface of the bore receptacle. The bore receptacle can include a polished bore receptacle or a tieback receptacle. The tieback casing can include a circulation port through the tieback casing, the circulation port configured to circulate a fluid from a central bore of the tieback casing to an annulus between the outer surface of the tieback casing and a wall of the wellbore. The at least one swellable seal can be configured to swell and cover the circulation port in the presence of an activation fluid. The at least one swellable seal of the seal system can include a first swellable seal and a second swellable seal, the first swellable seal positioned adjacent to and uphole of the circulation port, and the second swellable seal positioned adjacent to and downhole of the circulation port. The first swellable seal and the second swellable seal can be fixed to the portion of the outer surface of the tieback casing. The seal system can include the first swellable seal, the second swellable seal, a third seal, and a fourth seal, where the third seal is positioned at a downhole end of the seal system, and the fourth seal is positioned at an uphole end of the seal system. The at least one swellable seal can be configured to swell in the presence of an activation fluid. The activation fluid can include at least one of water or hydrocarbons.

Certain aspects of the disclosure encompass a method for sealing a wellbore liner-hanger tie-back system. The method includes engaging, with at least one swellable seal of a seal system, a tieback casing including the seal system with a bore receptacle disposed in a wellbore, the bore receptacle coupled to a liner hanger at a downhole end of the bore receptacle, and sealing, with the seal system, a space between the tieback casing and the bore receptacle.

This, and other aspects, can include one or more of the following features. Sealing the space between the tieback casing and the bore receptacle includes swelling the at least one swellable seal in the presence of an activation fluid. The at least one swellable seal can include two swellable seals, and sealing with the seal system can include sealing the space between the tieback casing and the bore receptacle with the two swellable seals and with two non-swellable seals. The bore receptacle can include a tieback receptacle or a polished bore receptacle.

Certain aspects of the disclosure encompass a method for sealing a wellbore liner-hanger tie-back system. The method includes lowering a tieback casing including a seal system into a wellbore, engaging at least one seal of the seal system of the tieback casing with a bore receptacle disposed in the wellbore, the bore receptacle coupled to a liner hanger at a downhole end of the bore receptacle, circulating cement through a circulation port in the tieback casing from a central bore of the tieback casing to a wellbore annulus between the tieback casing and a wall of the wellbore, and moving the tieback casing further into the wellbore to engage at least a second, swellable seal of the seal system with the bore receptacle and close the circulation port from fluid circulation between the central bore and the wellbore annulus.

This, and other aspects, can include one or more of the following features. The method can include swelling the second, swellable seal of the seal system into a space between the tieback casing and the bore receptacle adjacent the circulation port in response to contact with an activation fluid to close the circulation port from fluid circulation. Moving the tieback casing further into the wellbore to engage at least a second, swellable seal of the seal system with the bore receptacle can include engaging two swellable seals of the seal system with the bore receptacle and engaging two non-swellable seals of the seal system with the bore receptacle. The two swellable seals can be positioned adjacent to the circulation port, where a first swellable seal of the two swellable seals is positioned uphole of the circulation port, and a second swellable seal of the two swellable seals is positioned downhole of the circulation port. The bore receptacle can include a tieback receptacle or a polished bore receptacle.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
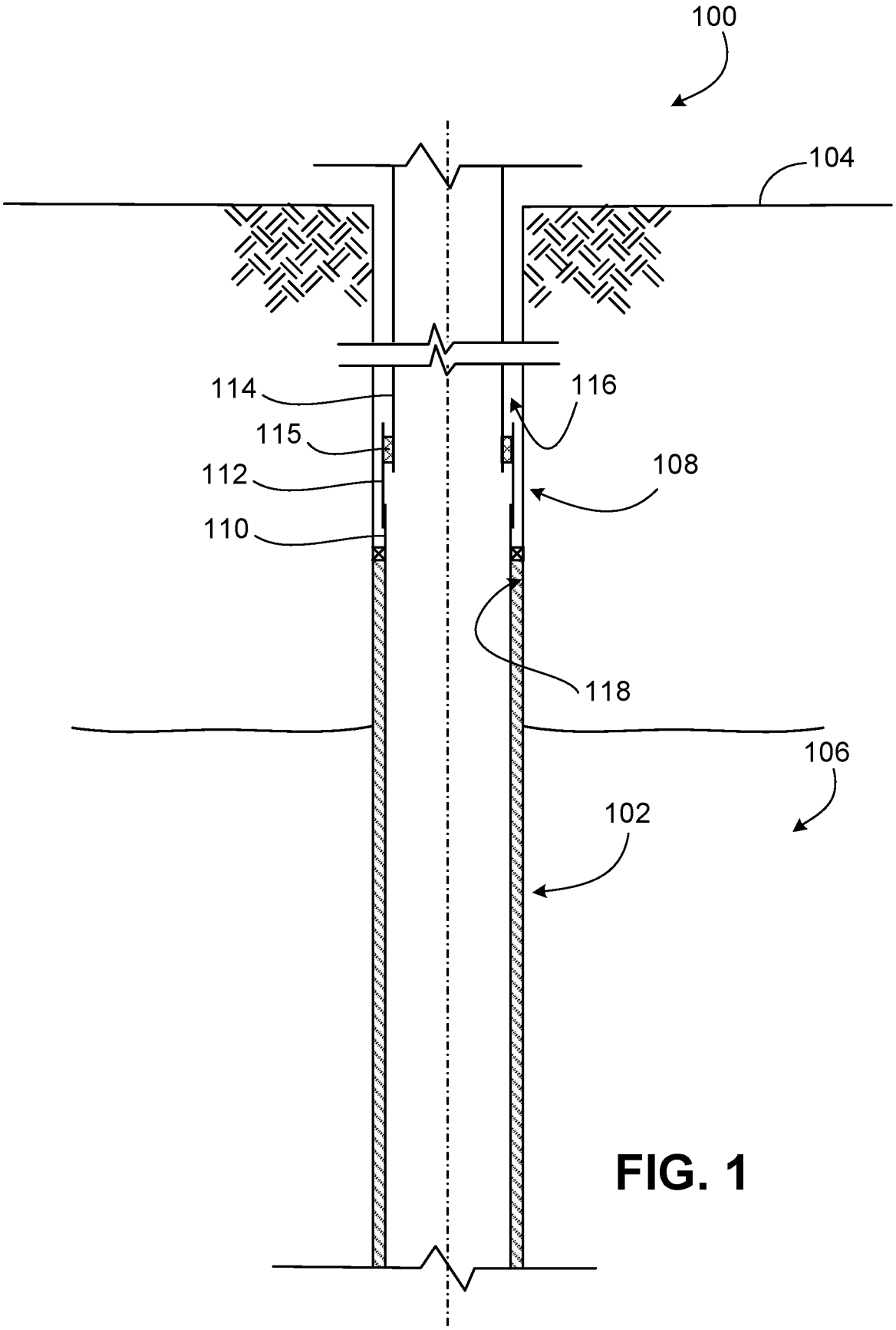
FIG. 1 is a schematic partial cross-sectional side view of an example well system.

This disclosure describes a wellbore liner-hanger tie-back system having a swellable seal system between a tieback casing and a bore receptacle. In some wells, during drilling or completion operations, a liner, such as a casing liner, is run into a wellbore, sealed to the wellbore with a packer element, and cemented in the wellbore. A bore receptacle at a top (for example, uphole end) of the liner hanger can support or receive (or both) a seal assembly that engages a tieback casing. The seal assembly includes one or more swellable seals between the tieback casing and the bore receptacle. For example, with the tieback casing and the bore receptacle both including substantially cylindrical structures, the seal system includes one or more ring-shaped swellable seals between a radially outer surface of the tieback casing and a radially inner surface of the bore receptacle. The seal system with the swellable seal positioned in the downhole wellbore environment provides an immediate fluid seal and a secondary sealing capability, for example, in the event of seal deterioration or failure. The swellable seal can activate, or reactivate after a shrinking or other deterioration of the swellable seal, in response to contact with an activating fluid (for example, formation fluid, water, hydrocarbons, or other fluid) and swell to fill and seal a space between the tieback casing and the bore receptacle. The swellable seal can act as a primary seal, a supplementary seal to standard seals to give the advantage of secondary sealing capability, or can be used as primary and secondary seals. For example, as one or more of the standard seals or swellable seals begin to fail or deteriorate, the presence of the activating fluid in contact with the swellable seal(s) can swell the swellable seal(s) and secure the seal (for example, fluid seal or pressure seal or both) between the tieback casing and the bore receptacle. The bore receptacle can include a tie-back receptacle (TBR), a polished back receptacle (PBR), or another type of bore receptacle. In some implementations, a circulation port through the tieback casing is positioned above a subset of seals of the seal system. The circulation port can circulate fluid, such as cement in a cementing operation, from a central bore of the tieback casing to the wellbore annulus. The wellbore annulus is the space between an outer wall of a tubing (such as the tieback casing) and an inner wall of the wellbore. For example, following a cementing operation through the circulation port, the tieback casing can be lowered (for example, moved downhole), pushing all the seals of the seal system between the tieback casing and the bore receptacle, thereby closing the circulation port and sealing the space between the tieback casing and the bore receptacle.

Seals between a tieback casing and a bore receptacle can be susceptible to deterioration and failure during the life of a well. In some seal systems, deteriorated or washed out seals allow fluid to channel behind the casing and damage cement in the casing, causing the cement to fail and casing-casing-annulus (CCA) pressure to develop. The swellable seal or seals described in this disclosure can activate and swell in response to an activation fluid, such as a formation fluid, water, oil, or other fluid, contacting the swellable seal or seals, for example, at any point during the life of a well. The swellable seal or seals can activate and swell at any point during the life of the well to ensure a sufficient seal between the tieback casing and the bore receptacle.

FIG. 1 is a schematic partial cross-sectional side view of an example well system 100 that includes a substantially cylindrical wellbore 102 extending from a surface 104 downward into the Earth into one or more subterranean zones of interest 106 (one shown). The well system 100 includes a vertical well, with the wellbore 102 extending substantially vertically from the surface 104 to the subterranean zone 106. The concepts herein, however, are applicable to many other different configurations of wells, including horizontal, slanted, or otherwise deviated wells. The well system 100 includes a liner-hanger tie-back system 108, which includes a liner 110, or casing, defined by lengths of tubing lining a portion of the wellbore 102. The liner 110 is shown as extending from a downhole portion of the wellbore 102 further downhole in the wellbore 102. The liner-hanger tie-back system 108 includes a bore receptacle 112 connected to the liner 110 at a top, uphole end of the liner 110. A tieback casing 114 is shown as having been lowered from the surface 104 into the wellbore 102, and seals to the bore receptacle 112 with a seal system 115. Although FIG. 1 shows a wellbore annulus 116 between the tieback casing 114 and an inner wall 118 of the wellbore 102 as empty, the wellbore annulus 116 can include cement, for example, following a cementing operation of the wellbore annulus 116.

Figure 2B:
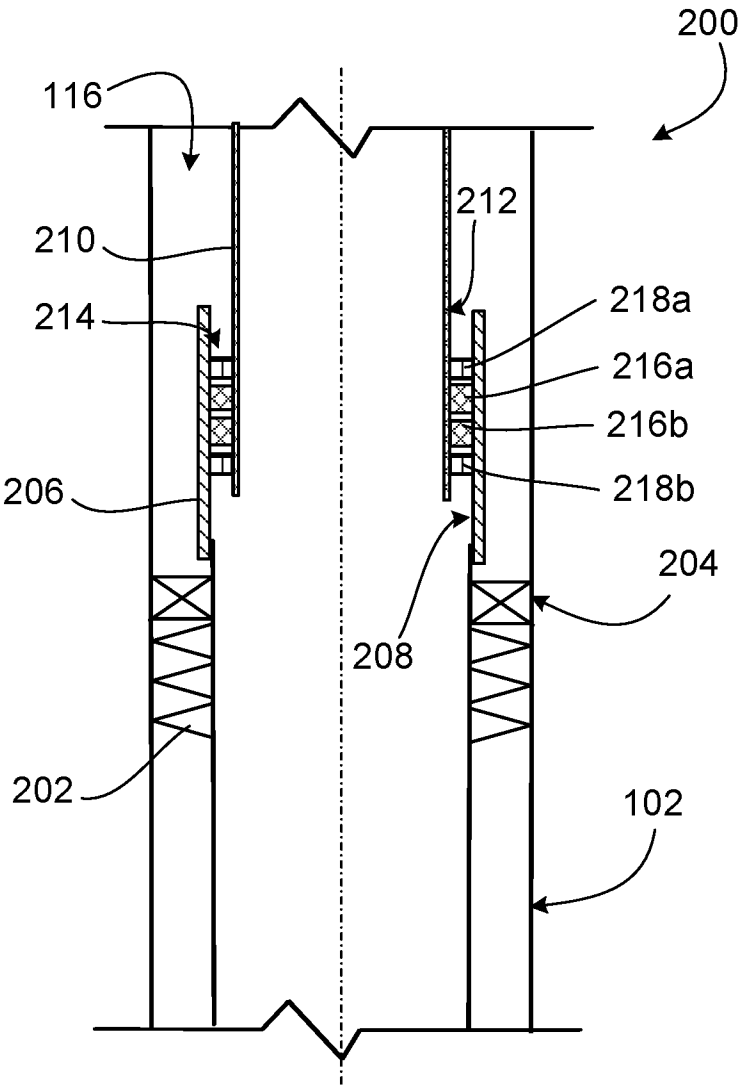
FIGS. 2A-2B are schematic cross-sectional side views of an example liner-hanger tie-back system in a wellbore.
Figure 2A:
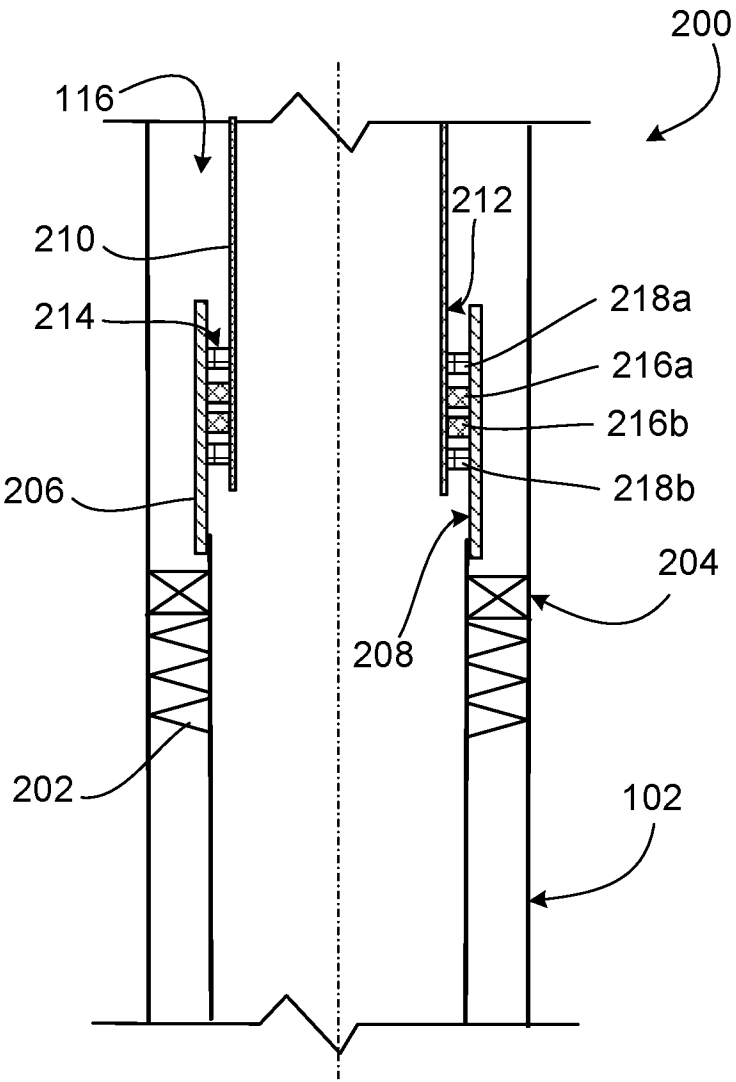

FIG. 2A is a schematic cross-sectional side view of an example liner-hanger tie-back system 200 that can be used in the liner-hanger tie-back system 108 of FIG. 1. The example liner-hanger tie-back system 200 is shown in FIG. 2A as positioned in wellbore 102. The example liner-hanger tie-back system includes a liner hanger 202, like liner 110 of FIG. 1, and attaches to the inner wall 118 of the wellbore 102 with a packer element 204. The liner hanger 202 is shown in FIG. 2A as fixed in the wellbore 102, for example, cemented in place. In some instances, the liner hanger 202 is supported in the wellbore 102 by the packer element 204 and is floating, or not cemented, in the wellbore 102. A bore receptacle 206, like the bore receptacle 112 of FIG. 1, is shown in FIG. 2A as engaged with the liner hanger 202 at a top, uphole end of the liner hanger 202, for example, by means of threading. For example, a downhole end of the bore receptacle 206 overlaps (e.g., threads with) a portion of the liner hanger 202 at the top, uphole end of the liner hanger 202, where an inner diameter of the bore receptacle 206 is substantially the same as or just larger than an outer diameter of the liner hanger 202. The bore receptacle 206 can also connect to the liner hanger 202 in various other ways. For example, the liner hanger 202 can overlap a portion of the bore receptacle 206, where an inner diameter of the liner hanger 202 is substantially the same as or just larger than an outer diameter of the bore receptacle 206. The bore receptacle 206 can include a variety of forms. For example, the bore receptacle 206 can include a polished bore receptacle (PBR), a tie-back receptacle (TBR), or another type of bore receptacle. The cross-section of the liner hanger 202, the bore receptacle 206, or both can be cylindrical, or can be shaped differently.

The example liner-hanger tie-back system 200 includes a tieback casing 210 positioned proximate to the bore receptacle 206. For example, a portion of an outer surface 212 of the tieback casing 210 is positioned adjacent to, and not directly contacting, an inner surface 208 of the bore receptacle 206. In some examples, the tieback casing 210 includes a cylindrical cross section, and the outer surface 212 is an outer cylindrical surface to substantially match an inner cylindrical surface of the bore receptacle 206. However, the cross section of the tieback casing 210 can be different.

A seal system 214 disposed between the tieback casing 210 and the bore receptacle 206 seals a space between the portion of the outer surface 212 of the tieback casing 210 and the inner surface 208 of the bore receptacle 206. The seal system 214 is fixed to the tieback casing 210, for example, to the portion of the outer surface 212 of the tieback casing 210. Seals of the seal system 214 are connected, or fixed, to the tieback casing 210 as it is run downhole, and the seals engage with the bore receptacle 206 when the tieback casing 210 is positioned downhole. The seal system 214 engages and seals to the bore receptacle 206, particularly to the inner surface 208 of the bore receptacle 206, when the tieback casing 210 is lowered in the wellbore 102 and positioned partially within the bore receptacle 206. The seal system 214 seals the space between the tieback casing 210 and the bore receptacle 206 from fluid communication between the central bore of the liner-hanger tie-back system and the wellbore annulus 116. In some implementations, the space between the tieback casing 210 and the bore receptacle 206 is an annular space between the outer surface 212 of the tieback casing 210 and the inner surface 208 of the bore receptacle 206.

The bore receptacle 206 has a smooth inner bore surface to seal against the seal system 214. In some implementations, the inner bore surface of the bore receptacle 206 can be different. For example, the bore receptacle 206 can include a segmented inner bore surface or notched inner bore surface, where the notches or segments line up with the seals of the seal system 214. In certain implementations, the seal system 214 can be fixed to the bore receptacle 206, for example, to the inner surface 208 of the bore receptacle 206, instead of to the tieback casing 210. In these implementations, an outer surface of the tieback casing can be smooth, segmented, or notched to match the seals of the seal system 214 when the tieback casing 210 is lowered into the wellbore into sealing engagement with the seal system 214.

The seal system 214 is shown in FIG. 2A as including four ring-shaped seals: a first swellable seal 216*a*, a second swellable seal 216*b*, a third seal 218*a*, and a fourth seal 218*b*. In FIG. 2A, the third seal 218*a* is positioned at an uphole end of the seal system 214, directly exposed to the wellbore annulus 116. The first swellable seal 216*a* and the second swellable seal 216*b* are positioned just downhole of the third seal 218*a*, and the fourth seal 218*b* is positioned at a downhole end of the seal system 214. The third seal 218*a* and the fourth seal 218*b* surround the swellable seals 216*a* and 216*b* on uphole and downhole ends of the seal system 214. However, the number or position (or both) of seals of the seal system 214 and the number or position (or both) of swellable seals of the seal system 214 can vary. For example, the seal system 214 can include one seal, two seals, five or more seals, or another number of seals. Also, the seal system 214 can include one swellable seal, two swellable seals, three or more swellable seals, or another number of swellable seals. The seal system 214 can include various combinations of swellable and non-swellable seals, for example, depending on wellbore requirements, pressure, sour service, a combination of these, or other factors. In certain implementations, the seal system 214 excludes standard seals, and includes only one or more swellable seals.

One or both of the swellable seals 216*a* and 216*b* swell in the presence of an activation fluid. The activation fluid can include formation fluid (such as oil, gas, water, a hybrid of these, or another formation fluid type), wellbore fluid, hydrocarbons, water, a combination of two or more of these fluids, or another type of fluid. FIG. 2B is a schematic cross-sectional side view of the example liner-hanger tie-back system 200 of FIG. 2A, except the first swellable seal 216*a* and the second swellable seals 216*b* in FIG. 2B are shown as swollen, or in a swelled state. For example, FIG. 2A shows the swellable seals 216*a* and 216*b* in a substantially unswelled state, whereas FIG. 2B shows the swellable seals 216*a* and 216*b* in a swelled state. In the swelled state, or swollen state, the swellable seals 216*a* and 216*b* expand to fill a volume greater than that of their unswelled state. The swellable seals 216*a* and 216*b* swell to a volume greater than or equal to that of the space it occupies when swollen, or in the swelled state, between the tieback casing 210 and the bore receptacle 206. In certain implementations, during the life of the well, the third seal 218*a* or the fourth seal 218*b* (or both) may begin to deteriorate or fail, allowing fluid communication to pass through the third seal 218*a* or fourth seal 218*b* (or both). The swellable seals 216*a* or 216*b* (or both) can swell in the presence of this fluid communication that bypasses the third seal 218*a* or fourth seal 218*b* (or both). The swellable seals 216*a* and 216*b* act as a secondary seal in the sealing system 214 in the presence of activation fluid. Since the activation fluid can include the formation fluid or other fluids that are known to travel through the central bore of the liner-hanger tie-back system 200, the first swellable seal 216*a* or second swellable seal 216*b*, or both, can swell in the presence of the activation fluid in the event of deterioration of one or more seals of the seal system 214.

Figure 3B:
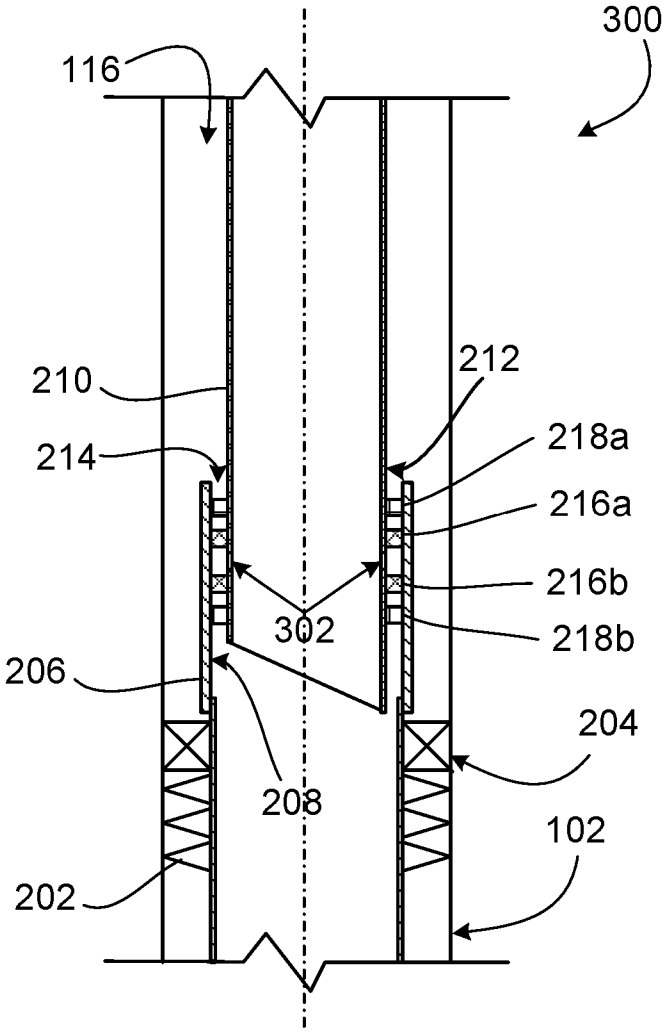
FIGS. 3A-3E are schematic cross-sectional side views of an example liner-hanger tie-back system in a wellbore.
Figure 3A:
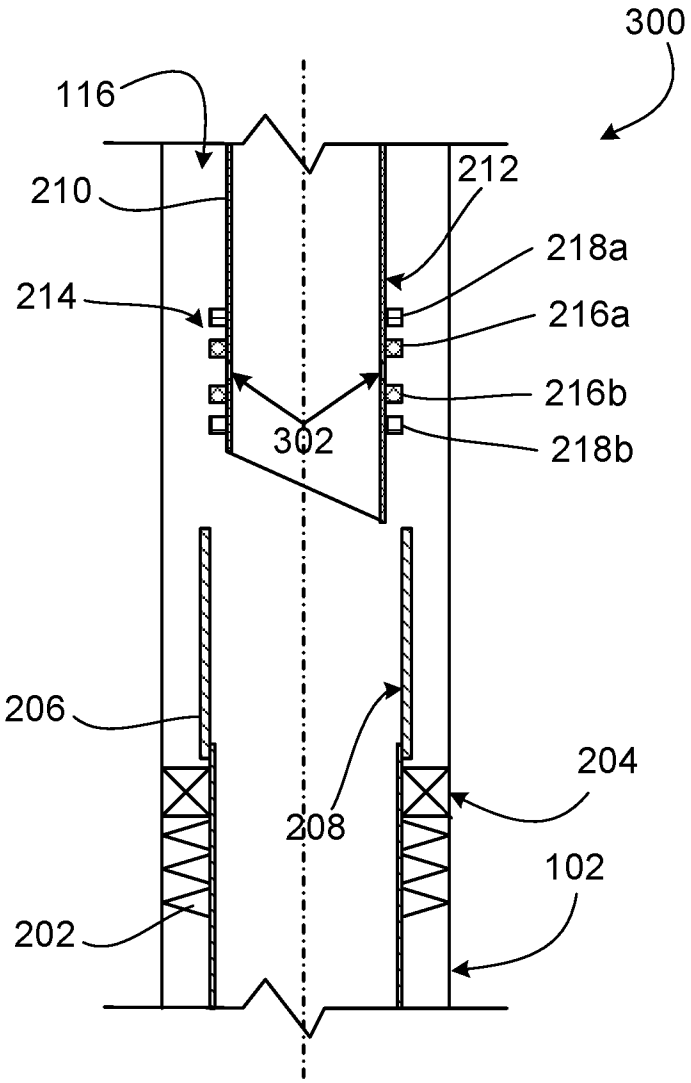

FIGS. 3A-3E are schematic cross-sectional side views of an example liner-hanger tie-back system 300 in wellbore 102. Example liner-hanger tie-back system 300 is like liner-hanger tie-back system 200 of FIGS. 2A-2B, except the tieback casing 210 includes a circulation port 302 through the wall of the tieback casing 210. The cross-sectional view of FIG. 3A shows two circulation ports 302, but the tieback casing 210 can include a different number of circulation ports 302, for example, one, three, or four or more circulation ports 302 radially disposed about the tieback casing 210. The circulation port 302 can be used to circulate a fluid, such as cement during a cementing operation, from the central bore of the tieback casing to the wellbore annulus 116 between the outer surface 212 of the tieback casing and the inner wall 118 of the wellbore 102. The circulation port 302 is positioned adjacent to the seal system 214, for example, between an uphole end and a downhole end of the seal system 214. In the example liner-hanger tie-back system 300, the first swellable seal 216*a* is positioned adjacent to and uphole of the circulation port 302, and the second swellable seal 216*b* is positioned adjacent to and downhole of the circulation port 302. The swellable seals 216*a* and 216*b* surround the circulation port 302. The position of the circulation port 302 can vary, for example, depending on the seal configuration and number of seals.

Figure 3D:
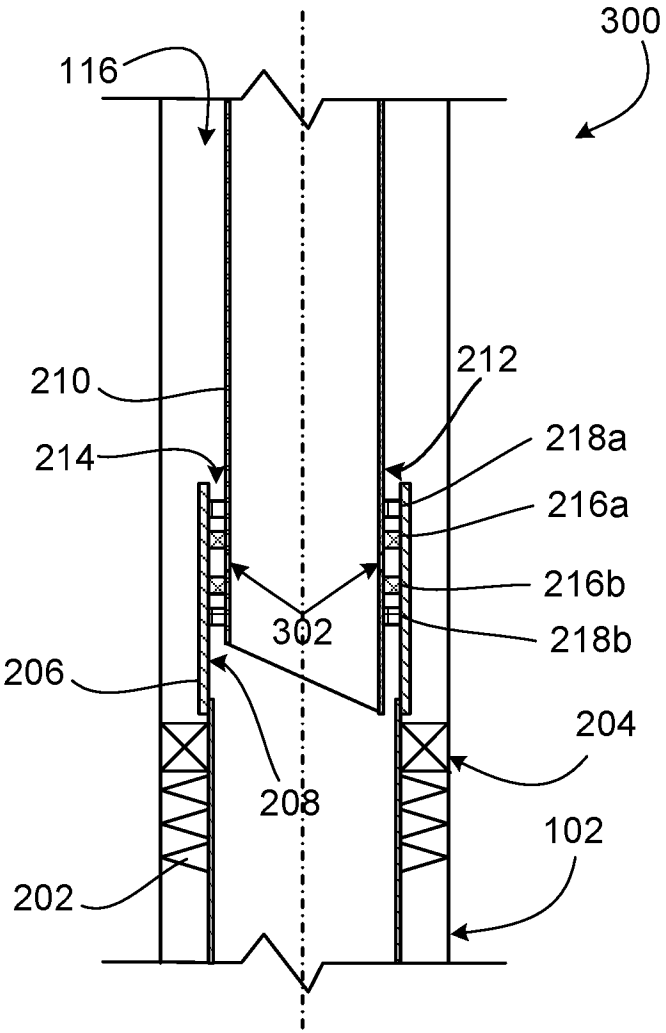
Figure 3C:
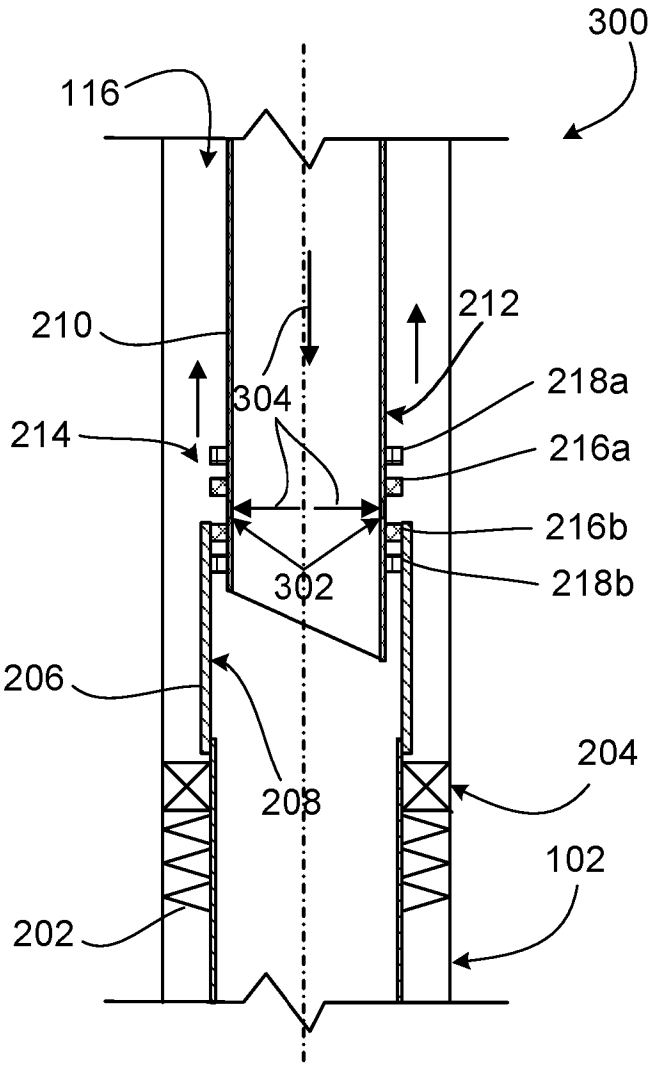

FIGS. 3A-3E show, in sequence, an example cementing operation through the circulation port 302 of the tieback casing 210. FIG. 3A shows the tieback casing 210 as being lowered downhole (e.g., into the wellbore 102) toward the bore receptacle 206. In FIG. 3B, the tieback casing 210 is positioned partially within the bore receptacle 206 such that the seal system 214 engages with the inner surface 208 of the bore receptacle 206. In some implementations, a pressure test of the seal system 214 is performed to ensure a sufficient seal is created at the seal system 214 between the tieback casing 210 and the bore receptacle 206. For example, a pressure applied at a surface of the wellbore 102 can ensure a pressure seal at the seal system 214, reveal if the seal system 214 leaks, or reveal if pressure bypasses the seal system 214. FIG. 3C shows the tieback casing 210 as having been partially raised uphole to expose the circulation port 302 to the wellbore annulus 116, also exposing a portion of the seal system 214 to the wellbore annulus 116. A downhole part of the seal system 214, for example, the seals downhole of the circulation port 302, remain in sealing engagement with the bore receptacle 206 to maintain the seal between the bore receptacle 206 and the tieback casing 210. An uphole part of the seal system 214, for example, the seals uphole of the circulation port 302, are separate from or disengaged from the bore receptacle for cementing. In some implementations, the tieback casing 210 is lowered into the wellbore 102 and into partial engagement of the seal system 214 shown in FIG. 3C. In other words, the complete engagement of the seal system 214 shown in FIG. 3B can be excluded.

In the example liner-hanger tie-back system 300 of FIG. 3C, the second swellable seal 216*b* and the fourth seal 218*b* remain engaged with the bore receptacle 206, while the first swellable seal 216*a* and the third seal 218*a* are uphole of and disengaged with the bore receptacle 206. This partially engaged orientation of the seal system 214 shown in FIG. 3C allows fluid to flow through the circulation port 302 between the central bore of the tieback casing 210 and the wellbore annulus 116. In FIG. 3C, cement from a well surface moves downhole through the central bore of the tieback casing 210, through the circulation port 302, and into the wellbore annulus 116, as indicated by arrows 304. The circulation port 302 allows circulation of the cement into the wellbore annulus 116. In some implementations, prior to circulation of cement through the circulation port 302, a cement plug (not shown) is pumped through the central bore of the tieback casing 210 and positioned just downhole of the circulation port 302 or tieback casing 210 to direct cement through the circulation port 302 and plug the central bore such that cement does not move further downhole through the central bore. FIG. 3D shows the tieback casing 210 as having been lowered back downhole, after the cementing operation has completed, to fully engage the seal system 214 with the bore receptacle 206. For example, the tieback casing 210 is lowered to push the first swellable seal 216*a* and the third seal 218*a* back between the outer surface 212 of the tieback casing 210 and the inner surface 208 of the bore receptacle to seal the space between the bore receptacle 206 and the tieback casing 210 and to close the circulation port 302 to fluid communication.

Figure 3E:
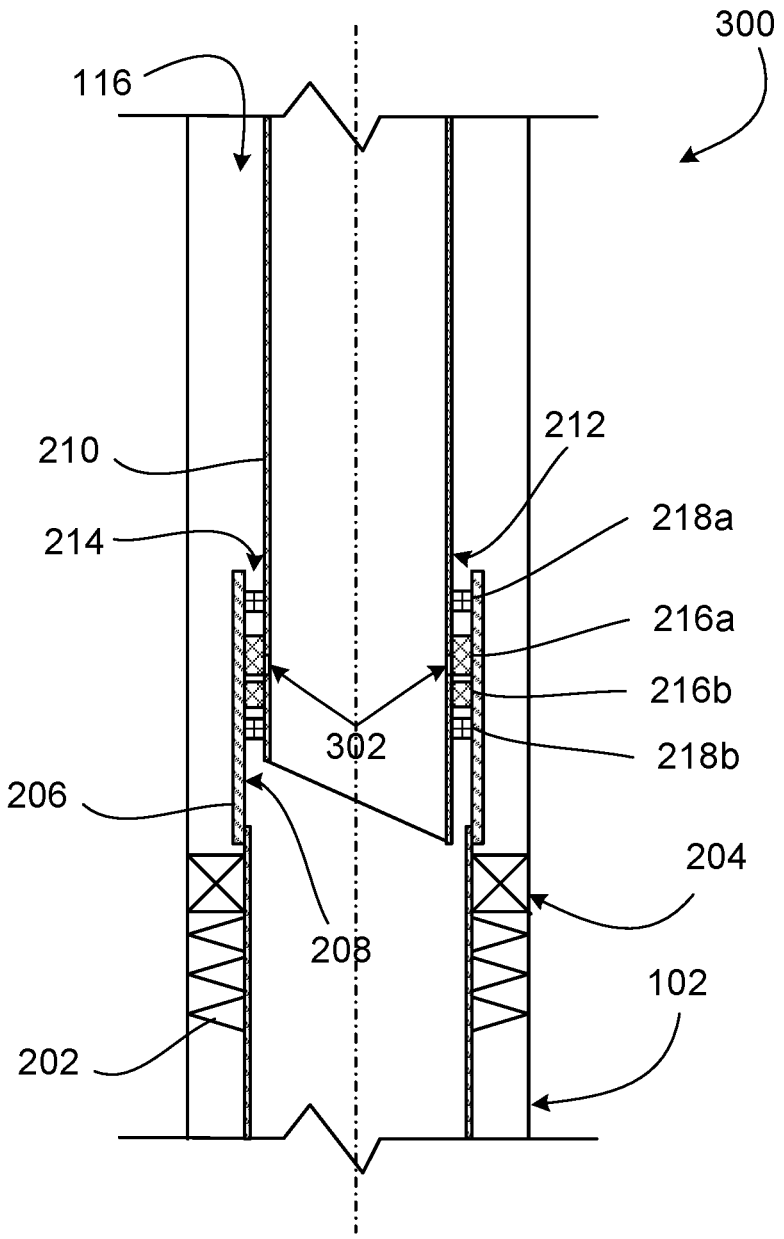

In some implementations, as shown in FIG. 3E, one of the swellable seals (such as swellable seal 216*a*) swells in response to contact with an activation fluid and covers the circulation port 302. The seal system 214 seals the space between the bore receptacle 206 and the tieback casing 210, and the swellable seal 216 closes the circulation port 302 to fluid circulation between the central bore and the wellbore annulus 116.

Figure 4:
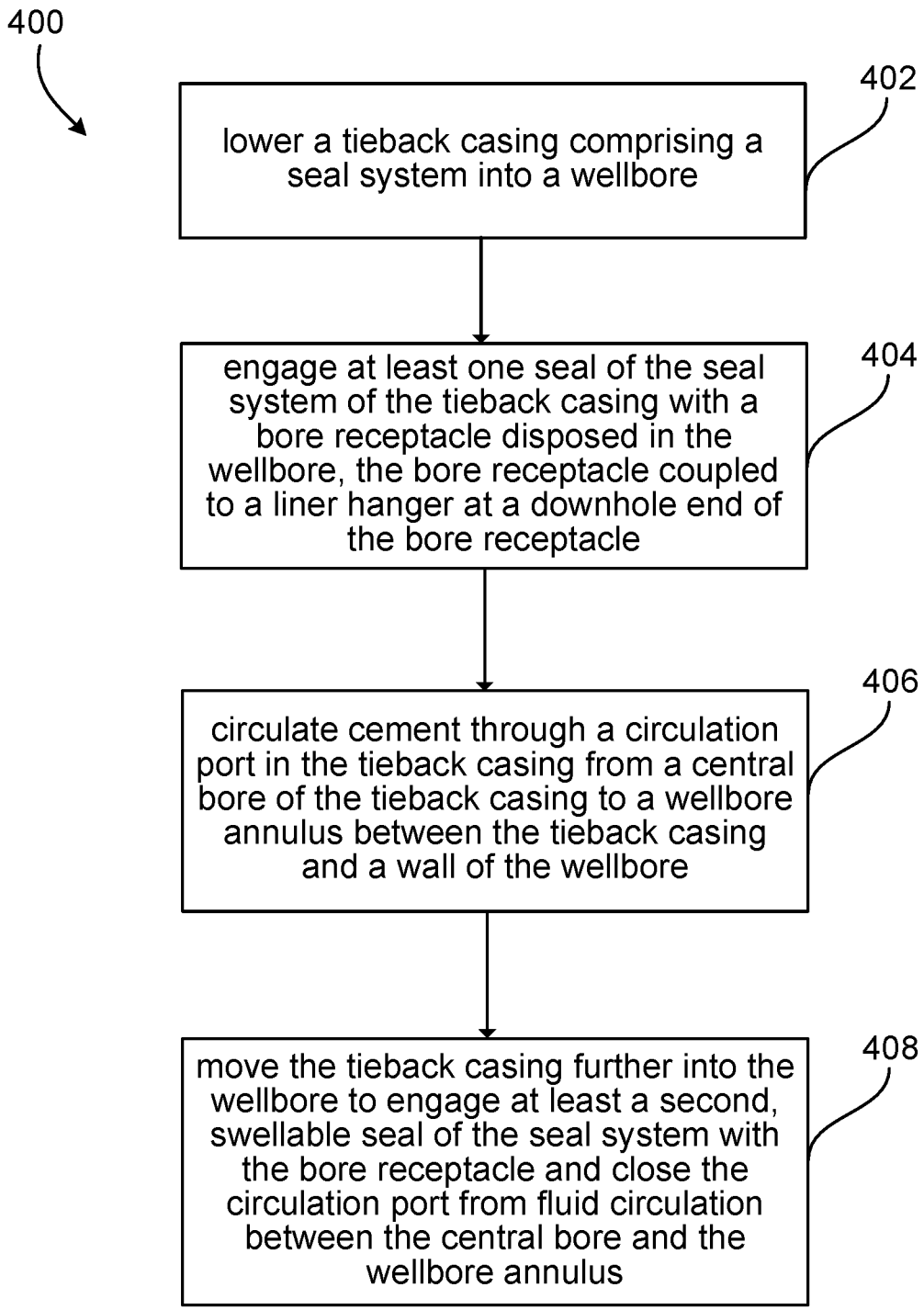
FIGS. 4-5 are flowcharts describing example methods for sealing a wellbore liner-hanger tie-back system.

FIG. 4 is a flowchart describing an example method 400 for sealing a wellbore liner-hanger tie-back system, for example, the liner-hanger tie-back system 300 described earlier. At 402, a tieback casing including a seal system is lowered into a wellbore. At 404, at least one seal of the seal system of the tieback casing engages with a bore receptacle disposed in the wellbore. The bore receptacle is coupled to a liner hanger at a downhole end of the bore receptacle. At 406, cement circulates through a circulation port in the tieback casing from a central bore of the tieback casing to a wellbore annulus between the tieback casing and a wall of the wellbore. At 408, the tieback casing moves further into the wellbore to engage at least a second, swellable seal of the seal system with the bore receptacle and close the circulation port from fluid circulation between the central bore and the wellbore annulus. The seal system can include various combinations of swellable and non-swellable seals, for example, depending on wellbore requirements, pressure, sour service, a combination of these, or other factors.

Figure 5:
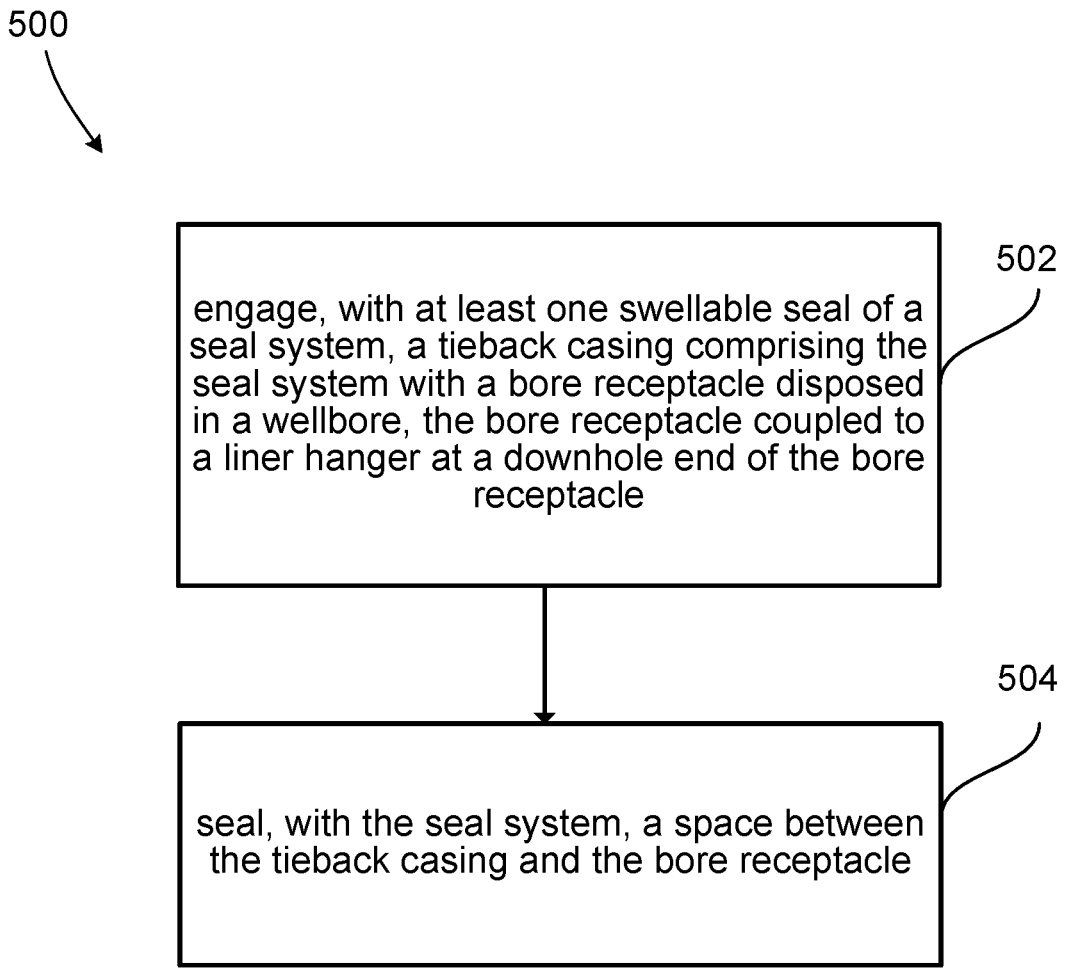

FIG. 5 is a flowchart describing an example method 500 for sealing a wellbore liner-hanger tie-back system, for example, performed by the liner-hanger tie-back system 200 described earlier. At 502, at least one swellable seal of a seal system engages a tieback casing including the seal system with a bore receptacle disposed in a wellbore. The bore receptacle is coupled to a liner hanger at a downhole end of the bore receptacle. At 504, the seal system seals a space between the tieback casing and the bore receptacle.

A number of implementations have been described. Nevertheless, it will be understood that various modifications may be made without departing from the spirit and scope of the disclosure.

What is claimed is:

1. A method for sealing a wellbore liner-hanger tie-back system, the method comprising:

lowering a tieback casing comprising a seal system into a wellbore;

engaging at least one seal of the seal system of the tieback casing with a bore receptacle disposed in the wellbore, the bore receptacle coupled to a liner hanger at a downhole end of the bore receptacle;

circulating cement through a circulation port in the tieback casing from a central bore of the tieback casing to a wellbore annulus between the tieback casing and a wall of the wellbore; and moving the tieback casing further into the wellbore to engage at least a second, swellable seal of the seal system with the bore receptacle and close the circulation port from fluid circulation between the central bore and the wellbore annulus, wherein the second, swellable seal of the seal system is configured to swell in response to an activation fluid leaking past a non-swellable seal of the seal system.

2. The method of claim 1, comprising swelling the second, swellable seal of the seal system into a space between the tieback casing and the bore receptacle adjacent the circulation port in response to contact with the activation fluid to close the circulation port from fluid circulation.

3. The method of claim 1, wherein moving the tieback casing further into the wellbore to engage at least a second, swellable seal of the seal system with the bore receptacle comprises engaging two swellable seals of the seal system with the bore receptacle and engaging two non-swellable seals of the seal system with the bore receptacle.

4. The method of claim 3, wherein the two swellable seals are positioned adjacent to the circulation port, where a first swellable seal of the two swellable seals is positioned uphole of the circulation port, and a second swellable seal of the two swellable seals is positioned downhole of the circulation port.

5. The method of claim 1, wherein the bore receptacle comprises a tieback receptacle or a polished bore receptacle.

* * * * *